US011299823B2

(12) United States Patent
Tsukamoto et al.

(10) Patent No.: US 11,299,823 B2
(45) Date of Patent: Apr. 12, 2022

(54) SPINNING APPARATUS AND SPINNING METHOD

(71) Applicant: Daicel Corporation, Tokyo (JP)

(72) Inventors: Yuki Tsukamoto, Tokyo (JP); Masahiro Haitsuka, Tokyo (JP)

(73) Assignee: Daicel Corporation, Osaka (JP)

( * ) Notice: Subject to any disclaimer, the term of this patent is extended or adjusted under 35 U.S.C. 154(b) by 0 days.

(21) Appl. No.: 17/073,080

(22) Filed: Oct. 16, 2020

(65) Prior Publication Data

US 2021/0032777 A1 Feb. 4, 2021

Related U.S. Application Data

(63) Continuation of application No. PCT/JP2019/014102, filed on Mar. 29, 2019.

(30) Foreign Application Priority Data

Apr. 20, 2018 (JP) ..... JP2018-081609

(51) Int. Cl.
*D01D 5/092* (2006.01)

(52) U.S. Cl.
CPC ..... *D01D 5/092* (2013.01)

(58) Field of Classification Search
CPC ..... D01D 5/04; D01D 5/0038; D01D 5/084; D01D 5/088; D01D 5/092
See application file for complete search history.

(56) References Cited

U.S. PATENT DOCUMENTS 2,811,409 A * 10/1957 Clapp ..... D01F 6/18 264/206
2,829,027 A 4/1958 Raynolds et al.
(Continued)

FOREIGN PATENT DOCUMENTS

GB 1040307 8/1966
JP S28-6211 12/1953
(Continued)

OTHER PUBLICATIONS

Extended European Search Report for EP Application No. 19787826.7, dated Apr. 22, 2021 in 6 pages.
(Continued)

*Primary Examiner* — Niki Bakhtiari
*Assistant Examiner* — Emmanuel S Luk
(74) *Attorney, Agent, or Firm* — Knobbe Martens Olson & Bear, LLP

(57) ABSTRACT

A spinning apparatus includes a spinning cabinet extending in a vertical direction, a spinneret that includes a plurality of spinneret holes, is disposed on an upper end side of the spinning cabinet, and is configured to extrude a spinning dope from the plurality of spinneret holes into an interior space of the spinning cabinet, a first gas supply path connected to the spinning cabinet is configured to supply a first gas from above the spinneret to the interior space, allowing the first gas to come into contact with the spinning dope extruded from the plurality of spinneret holes, and a second gas supply path connected to the spinning cabinet is configured to supply a second gas having a higher temperature than that of the first gas from below the spinneret to the interior space, allowing the second gas to come into contact with the spinning dope extruded from the plurality of spinneret holes.

12 Claims, 2 Drawing Sheets

(56) References Cited

U.S. PATENT DOCUMENTS 2,838,364 A * 6/1958 Smith ..... D01D 5/24 264/177.13
3,062,611 A * 11/1962 Keen ..... A24D 3/0237 264/131
3,080,611 A * 3/1963 Jarrett ..... D01D 5/22 156/167
3,094,374 A * 6/1963 Smith ..... D01F 6/70 264/103
3,111,368 A * 11/1963 Romano ..... D01D 5/04 264/205
3,489,832 A * 1/1970 Bruton ..... D01D 5/08 264/237
4,909,976 A * 3/1990 Cuculo ..... D01F 6/62 264/211.15
5,141,700 A * 8/1992 Sze ..... D01D 5/092 264/210.2
5,173,310 A * 12/1992 Katou ..... D01D 5/088 264/211.13
5,262,110 A 11/1993 Spaller, Jr. et al.
5,766,646 A * 6/1998 Geus ..... D04H 3/16 264/168
6,103,158 A * 8/2000 Schafer ..... D01D 5/092 264/103
6,168,406 B1 * 1/2001 Tseng ..... D01D 5/088 425/378.2
6,379,136 B1 * 4/2002 Najour ..... D04H 3/16 425/463
6,716,014 B2 * 4/2004 Schafer ..... D01D 5/092 425/66
6,783,722 B2 * 8/2004 Taylor ..... D01D 5/0985 264/103
7,501,082 B2 * 3/2009 Mencke ..... D01F 6/04 264/290.5
2001/0015508 A1 * 8/2001 Schafer ..... D01D 5/092 264/101
2007/0284776 A1 * 12/2007 Hisada ..... D01D 5/088 264/211.22

FOREIGN PATENT DOCUMENTS

JP S39-29673 12/1964
JP 9-501989 2/1997
JP 2013-53398 3/2013

OTHER PUBLICATIONS

International Search Report for PCT Application No. PCT/JP2019/014102, dated Jun. 25, 2019, in 2 pages.

* cited by examiner

SPINNING APPARATUS AND SPINNING METHOD

BACKGROUND OF THE INVENTION

Technical Field

The present inventions relate to a spinning apparatus and a spinning method.

Description of the Related Art

A spinning apparatus, as disclosed in Japanese Published Application JP H9-501989, for example, includes a spinneret in which a plurality of spinneret holes are formed, and a spinning cabinet extending in a vertical direction with the spinneret disposed on an upper end side of the spinning cabinet. When spinning is performed by the spinning apparatus, for example, a spinning dope containing a filament raw material component and a volatile (solvent) component is extruded into the spinning cabinet from the spinneret holes of the spinneret. The spinning dope is dried by coming into contact with a gas supplied into the spinning cabinet. In this way, a plurality of filaments (single fibers) are spun. The plurality of filaments are bundled into yarn, wound onto a godet roller, and then transported in a predetermined direction.

SUMMARY OF THE INVENTION

With regard to a spinning apparatus, it has been desired to reduce production costs by improving the efficiency of spinning. Examples of methods for improving spinning efficiency include a method of improving draft, which is defined as a ratio of a winding speed of the godet roller to an extrusion speed of the spinning dope from the spinneret hole. Nevertheless, simply increasing the winding speed relative to the extrusion speed may make it difficult to improve the draft due to the occurrence of filament breakage in the spinning cabinet.

Therefore, an object of the present invention is to make it possible to improve spinning efficiency in a spinning apparatus by preventing filament breakage that occurs in a spinning cabinet.

One of the causes of filament breakage in the spinning cabinet when trying to improve the draft is presumably that, immediately after the spinning dope is extruded from the spinneret, the volatile component of the spinning dope is volatilized rapidly by the gas supplied into the spinning cabinet, making it difficult to draw the spinning dope.

With regard to this problem, it was found that, when a supply amount per unit time of the gas supplied into the spinning cabinet is simply reduced or a temperature of the gas supplied into the spinning cabinet is simply reduced, the spinning dope is not sufficiently dried, and streams of the spinning dope extruded from the plurality of spinneret holes in the spinning cabinet come into contact with each other due to filament sway, resulting in the occurrence of filament breakage.

At least one of the present inventions is based on such knowledge, and improves the ability to draw a spinning dope well, immediately after being extruded from spinneret holes, and dry the spinning dope while preventing filament breakage caused by contact between a plurality of streams of the spinning dope in the spinning cabinet.

That is, a spinning apparatus according to an embodiment includes a spinning cabinet extending in a vertical direction, a spinneret that includes a plurality of spinneret holes, is disposed on an upper end side of the spinning cabinet, and is configured to extrude a spinning dope from the plurality of spinneret holes into an interior space of the spinning cabinet. A first gas supply path can be connected to the spinning cabinet and configured to supply a first gas from above the spinneret to the interior space, allowing the first gas to come into contact with the spinning dope extruded from the plurality of spinneret holes. A second gas supply path can be connected to the spinning cabinet and configured to supply a second gas having a higher temperature than that of the first gas from below the spinneret to the interior space, allowing the second gas to come into contact with the spinning dope extruded from the plurality of spinneret holes.

According to the configuration described above, the spinning dope immediately after being extruded from the spinneret holes, comes into contact with the first gas supplied by the first gas supply path from above the spinneret, and thus is dried relatively slowly. As a result, the spinning dope immediately after being extruded from the spinneret holes, is prevented from drying rapidly, the spinning dope can be drawn while preventing filament breakage, and thus the draft can be improved.

Further, by contacting the spinning dope extruded from the spinneret holes with the second gas supplied by the second gas supply path from below the spinneret, drying is promoted. As a result, the spinning dope can be dried while preventing the occurrence of filament breakage caused by a plurality of streams of the spinning dope coming into contact with each other during drying in the spinning cabinet. Further, the second gas can be supplied to the interior space of the spinning cabinet separately from the first gas, making it possible to more easily control the temperatures and supply amounts of the first gas and the second gas individually. Thus, the spinning efficiency can be improved.

The spinning apparatus may further include a third gas supply path connected to the spinning cabinet, below a position at which the second gas is supplied to the spinning cabinet, and configured to supply a third gas to the interior space, allowing the third gas to come into contact with the spinning dope extruded from the plurality of spinneret holes. As a result, the spinning dope dried to a certain degree by the second gas can be further dried by the third gas supplied from the third gas supply path.

The spinning cabinet may include a gas discharge port configured to discharge gas from the interior space to outside the spinning cabinet. The gas discharge port may be disposed between the position at which the second gas is supplied to the spinning cabinet and a position at which the third gas is supplied to the spinning cabinet.

As a result, in the interior space of the spinning cabinet, the third gas can be made to flow upward from below, from the position at which the third gas is supplied toward a position of the gas discharge port. As such, a gas having a low volatile component concentration can be brought into contact with the spinning dope transported through the interior space to efficiently dry the spinning dope.

The first gas supply path may be configured to supply the first gas in a longitudinal direction of the spinning cabinet, from above the spinneret toward below the spinneret. As a result, the spinning dope can be slowly dried by the first gas while preventing streams of the spinning dope immediately after being extruded from each of the spinneret holes from coming into contact with each other due to the occurrence of filament sway caused by the first gas, and thus the draft can be improved.

Further, a spinning method according to another embodiment includes disposing a spinneret including a plurality of spinneret holes on an upper end side of a spinning cabinet extending in a vertical direction, extruding a spinning dope from the plurality of spinneret holes into an interior space of the spinning cabinet, supplying a first gas from above the spinneret to the interior space, allowing the first gas to come into contact with the spinning dope passing through the plurality of spinneret holes, and supplying a second gas having a higher temperature than that of the first gas from below the spinneret to the interior space, allowing the second gas to come into contact with the spinning dope extruded from the plurality of spinneret holes.

The spinning method may further include supplying a third gas to the interior space, below a position at which the second gas is supplied to the spinning cabinet, allowing the third gas to come into contact with the spinning dope extruded from the plurality of spinneret holes.

A gas may be discharged from the interior space to outside the spinning cabinet, vertically between the position at which the second gas is supplied to the spinning cabinet and a position at which the third gas is supplied to the spinning cabinet.

The first gas may be supplied from above the spinneret toward below the spinneret.

In at least some embodiments, spinning efficiency can be improved in a spinning apparatus by reducing or preventing filament breakage that occurs in a spinning cabinet.

DETAILED DESCRIPTION OF THE PREFERRED EMBODIMENT

Figure 1:
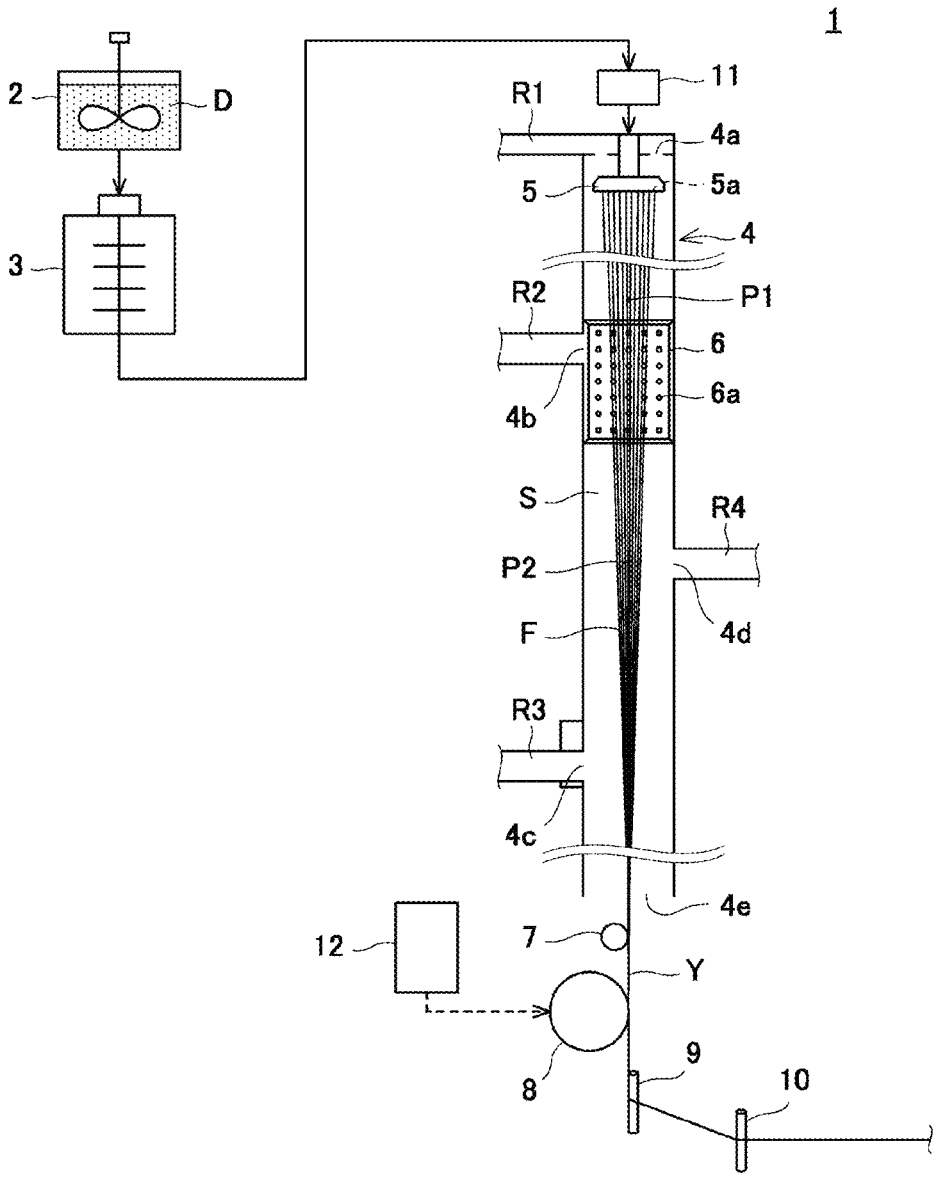
FIG. 1 is a general, schematic view of spinning apparatus according to an embodiment.

Embodiments are described below with reference to the drawings. FIG. 1 is a general, schematic view of a spinning apparatus 1 according to an embodiment. The spinning apparatus 1, as an example, spins a filament F of a cellulose acetate fiber by dry spinning.

The spinning apparatus 1 includes a mixing device 2, a filtration device 3, a spinning cabinet 4, a spinneret 5, a first gas supply path R1, a second gas supply path R2, a third gas supply path R3, a gas discharge path R4, a diffuser 6, an oil agent impregnating unit 7, a godet roller 8, and guide members 9, 10. Although not illustrated in FIG. 1, the spinning apparatus 1 of the present embodiment includes a plurality of the spinning cabinets 4, and the supply paths R1 to R3 are branched and connected to each of the spinning cabinets 4.

The mixing device 2 mixes a spinning dope D. The spinning dope D includes a raw material component of the filament F and a volatile component. As an example, the raw material component of the filament F is cellulose acetate and the volatile component is acetone. The filtration device 3 filters the spinning dope D mixed by the mixing device 2.

The spinning cabinet 4 extends in a vertical direction. In the spinning cabinet 4, a first gas supply port 4*a*, a second gas supply port 4*b*, a third gas supply port 4*c*, a gas discharge port 4*d*, and a filament transport port 4*e* are provided spaced apart from each other in a longitudinal (vertical) direction of the spinning cabinet 4. Of these, the second gas supply port 4*b*, the third gas supply port 4*c*, and the gas discharge port 4*d* are disposed on a side portion of the spinning cabinet 4.

The first gas supply port 4*a* is disposed on an upper end of the spinning cabinet 4 and is connected to the first gas supply path R1. The second gas supply port 4*b* is disposed below a lower end of the spinneret 5 and is connected to the second gas supply path R2. The third gas supply port 4*c* is disposed below the second gas supply port 4*b* and is connected to the third gas supply path R3.

The gas discharge port 4*d* is disposed vertically between a position at which the second gas is supplied to the spinning cabinet 4 and a position at which the third gas is supplied to the spinning cabinet 4 (in other words, vertically between the second gas supply port 4*b* and the third gas supply port 4*c*), and discharges a gas from an interior space S to outside the spinning cabinet 4. The gas discharge port 4*d* is connected to the gas discharge path R4. The filament transport port 4*e* is disposed at a lower end of the spinning cabinet 4, and transports the filament F spun in the spinning cabinet 4 to outside the spinning cabinet 4.

As a specific example, the second gas supply port 4*b* is disposed above a center of the spinning cabinet 4 in the longitudinal direction. Further, as an example, the second gas supply port 4*b* is disposed at a position below a center position P1 between the upper end of the spinning cabinet 4 and an upper end of the gas discharge port 4*d*. An upper end of the second gas supply port 4*b* is positioned below the lower end of the spinneret 5. The upper end of the second gas supply port 4*b* is preferably disposed at a position downward from the upper end of the spinning cabinet 4 at a distance within a range of not less than 20% and not greater than 30% of a length dimension of the spinning cabinet 4.

Further, the gas discharge port 4*d* is disposed below the center of the spinning cabinet 4 in the longitudinal direction. As an example, the gas discharge port 4*d* is disposed at a position overlapping with a center position P2 between a lower end of the second gas supply port 4*b* and an upper end of the third gas supply port 4*c*. Thus, at least a portion of the gas discharge port 4*d* can be positioned below the center position P2.

Further, a length dimension from the upper end of the spinning cabinet 4 to the upper end of the gas discharge port 4*d* is longer than a length dimension from the lower end of the second gas supply port 4*b* to the upper end of the third gas supply port 4*c* of the spinning cabinet 4. Further, a length dimension from the upper end of the spinning cabinet 4 to the upper end of the second gas supply port 4*b* is longer than a length dimension from the lower end of the spinning cabinet 4 to a lower end of the third gas supply port 4*c*.

The spinneret 5 includes a plurality of spinneret holes 5*a*, and is disposed on the upper end side of the spinning cabinet 4. The spinneret 5 extrudes the spinning dope D from the spinneret holes 5*a* into the interior space S of the spinning cabinet 4. The spinning apparatus 1 pressurizes the spinning dope D by a pump 11, and extrudes the spinning dope D from the spinneret holes 5*a*. An extrusion speed V1 at which the spinning dope D is extruded from the spinneret holes 5*a* is set by adjusting the pump 11.

The first gas supply path R1 is connected to the spinning cabinet 4, and supplies a first gas to the interior space S from above the spinneret 5, allowing the first gas to come into contact with the spinning dope D extruded from the spinneret holes 5*a*. In the present embodiment, the first gas supply port 4*a* of the spinning cabinet 4 connected to the first gas supply path R1 is disposed above the spinneret 5 in the interior space S of the spinning cabinet 4. As a result, the first gas supply path R1 is disposed capable of supplying the first gas in the longitudinal direction of the spinning cabinet 4, from above the spinneret 5 toward below the spinneret 5. As an example, a temperature of the first gas supplied to the interior space S is set to a value within a range of not less than 60° C. and not greater than 70° C.

The second gas supply path R2 is connected to the spinning cabinet 4, and supplies a second gas having a higher temperature than the first gas to the interior space S from below the spinneret 5, allowing the second gas to come into contact with the spinning dope D extruded from the spinneret holes 5*a*. In the present embodiment, the second gas supply path R2 is configured to supply the second gas to the interior space S of the spinning cabinet 4, from the side of the spinning cabinet 4. A temperature of the second gas supplied to the interior space S is, as an example, higher than 70° C., and herein is set to a value within a range of not less than 90° C. and not greater than 95° C.

Further, as an example, a supply amount of the second gas to the interior space S per unit time, which can be referred to as a gas supply rate, is set to a value equal to or greater than a supply amount of the first gas to the interior space S per unit time, which can also be referred to as a gas supply rate. As an example, the supply amount of the second gas to the interior space S per unit time is set to a value within a range of not less than 100% and not greater than 143% of the supply amount of the first gas to the interior space S per unit time.

The third gas supply path R3 is connected to the spinning cabinet 4, below the position at which the second gas is supplied to the spinning cabinet 4, and is configured to supply a third gas to the interior space S, allowing the third gas to come into contact with the spinning dope D extruded from the spinneret holes 5*a*. In the present embodiment, the third gas supplied to the interior space S has a higher temperature than the first gas. Further, the third gas supply path R3 is configured to supply the third gas to the interior space S of the spinning cabinet 4, from the side of the spinning cabinet 4. The third gas may have a temperature higher than the second gas or may have a temperature lower than the second gas. Here, the first to third gases are drying gases for drying the spinning dope D and are all, as an example, air.

The discharge path R4 is connected to the spinning cabinet 4, vertically between the position at which the second gas is supplied to the spinning cabinet 4 and the position at which the third gas is supplied to the spinning cabinet 4, and discharges a gas from the interior space S of the spinning cabinet 4.

The diffuser 6 supplies the second gas supplied to the interior space S of the spinning cabinet 4 to an inner side of the spinning cabinet 4 in a radial direction while diffusing the second gas below the spinneret 5. The diffuser 6 is a cylindrical body, and is disposed in the interior space S with a cylinder axial direction thereof aligned with the longitudinal direction of the spinning cabinet 4. A plurality of openings 6*a* are formed in a circumferential surface of the diffuser 6. The second gas, by passing through the openings 6*a* of the diffuser 6, is supplied to an inner side of the diffuser 6 in the radial direction while being diffused.

Note that, in a case where the second gas is sufficiently diffused in the interior space S without use of the diffuser 6 or the like, the diffuser 6 may be omitted. The oil agent impregnating unit 7 impregnates the spun filament F with a fiber oil agent (as an example, a fiber oil agent emulsion).

The godet roller 8 is rotatably supported about a roller axis thereof. The godet roller 8 comes into contact with the filament F at a circumferential surface thereof while being rotated by a driving force transmitted from a drive device 12, thereby transporting the filament F toward the guide members 9, 10. A rotation speed (winding speed) V2 of the godet roller 8 is adjusted by the drive device 12.

In the spinning apparatus 1, a draft V2/V1 is adjusted by adjusting the speeds V1, V2 individually. The draft V2/V1 can be set as appropriate. However, with the draft V2/V1 set to a value greater than 1.0, the spinning dope D extruded from the spinneret holes 5*a* of the spinneret 5 is drawn in a transport direction. In the present embodiment, the draft V2/V1 is set to a value greater than 1.0 as an example. The guide members 9, 10 guide the filament F transported from the godet roller 8 in a predetermined direction.

In a spinning method of the present embodiment, spinning is performed using the spinning apparatus 1 having the configuration described above. That is, the spinneret 5 is disposed on the upper end side of the spinning cabinet 4, the spinning dope D is extruded from the spinneret holes 5*a* into the interior space S of the spinning cabinet 4, and the first gas is supplied from above the spinneret 5 to the interior space S, allowing the first gas to come into contact with the spinning dope D passing through the spinneret holes 5*a*.

Further, the second gas having a higher temperature than the first gas is supplied to the interior space S from below the spinneret 5, allowing the second gas to come into contact with the spinning dope D extruded from the spinneret holes 5*a*. As an example, the first gas is supplied from above the spinneret 5 toward below the spinneret 5.

Further, the third gas is supplied to the interior space S, below the position at which the second gas is supplied to the spinning cabinet 4, allowing the third gas to come into contact with the spinning dope D extruded from the spinneret holes 5*a*. Further, a gas is discharged from the interior space S to outside the spinning cabinet 4, vertically between the position at which the second gas is supplied to the spinning cabinet 4 and the position at which the third gas is supplied to the spinning cabinet 4.

For example, when the spinning apparatus 1 is driven, the spinning dope D that has passed through the mixing device 2 and the filtration device 3 is extruded downward from above, from the spinneret holes 5*a* of the spinneret 5 toward the interior space S of the spinning cabinet 4, by the driving force of the pump 11. Further, the first gas is supplied from the first gas supply path R1 to the interior space S of the spinning cabinet 4 via the first gas supply port 4*a*.

The temperature of the first gas supplied to the interior space S is set lower than the temperature of the second gas supplied to the interior space S so that the spinning dope D immediately after being extruded from the spinneret holes 5*a* is slowly dried. Accordingly, the volatile component of the spinning dope D is partially volatilized by the first gas immediately after the spinning dope D is extruded from the spinneret holes 5*a*, but remains in the spinning dope D to the extent that the spinning dope D is drawn in accordance with the value of the draft V2/V1 set in advance. As a result, in the spinning apparatus 1, the spinning dope D extruded from the spinneret holes 5*a* is stably drawn in the transport (vertical) direction while being slowly dried by the first gas.

Here, a diameter of the spinning dope D extruded from the spinneret holes 5*a* becomes narrower when the winding speed V2 is increased while the supply amount of the spinning dope D to the spinneret 5 is kept constant. Then, it becomes impossible to stably wind the filament F spun from the spinning dope D by the godet roller 8. The ratio V2/V1 at which stable winding with the godet roller becomes impossible is defined as the "maximum draft".

In the present embodiment, the spinning dope D immediately after being extruded from the spinneret holes 5*a* can be stably drawn, making it possible to increase the maximum draft V2/V1. As a result, for example, the maximum draft V2/V1 can be increased when the winding speed V2 is set to be equivalent to that in the related art can be increased, and the maximum draft V2/V1 can be prevented from decreasing even when the winding speed V2 is set to a speed higher than that in the related art.

Further, the second gas is supplied from the second gas supply path R2 to the interior space S via the second gas supply port 4*b*. The second gas comes into contact with the spinning dope D while being diffused by the diffuser 6 in the interior space S. With the second gas having a higher temperature than the first gas, the spinning dope D comes into contact with the second gas, thereby promoting the volatilization of the volatile component of the spinning dope D.

When the volatilization of the volatile component of the spinning dope D progresses to a certain degree, a skin layer is formed on the spinning dope D, and the spinning dope D solidifies to form the filament F. In the present embodiment, the second gas having a higher temperature than the first gas is brought into contact with the spinning dope D to promote volatilization of the volatile component of the spinning dope D, and thus a plurality of the filaments F can be favorably formed while preventing a plurality of streams of the spinning dope D extruded from the plurality of spinneret holes 5*a* from coming into contact with each other by the gas flowing through the interior space S and breaking (breaking by filament sway).

Further, the third gas is supplied from the third gas supply path R3 to the interior space S via the third gas supply port 4*c*. In the spinning cabinet 4, the gas discharge port 4*d* is disposed above the third gas supply port 4*c*, and thus the third gas flows upward through the interior space S from below, from the second gas supply port 4*b* toward the gas discharge port 4*d*.

Therefore, the filament F being transported can come into contact with the third gas in a state in which the volatile component concentration is relatively low by counterflow drying in the interior space S, thereby further promoting drying. The first to third gases containing the volatile component are discharged from the gas discharge port 4*d* to outside the spinning cabinet 4, flow through the discharge path R4, and are subsequently collected.

Here, in the interior space S, the first gas flows downward from above, the second gas is mixed with the first gas, and the mixture flows downward from above. As an example, a region between the second gas supply port 4*b* and the gas discharge port 4*d* of the interior space S includes a region in the interior space S where a flow rate of the gas is highest. Further, as an example, a region between the upper end of the spinning cabinet 4 in the interior space S and the second gas supply port 4*b* includes a region in the interior space S where the flow rate of the gas is lowest.

The filament F transported from the filament transport port 4*e* of the spinning cabinet 4 is bundled into a yarn Y. The yarn Y is impregnated with the fiber oil agent by the oil agent impregnating unit 7, and subsequently wound by the godet roller 8. The yarn Y travels around the circumferential surface of the godet roller 8, and is subsequently transported in a predetermined direction while being guided by the guide members 9, 10.

Note that the third gas supply port 4*c* is disposed below the gas discharge port 4*d* as an example, but may be disposed below the second gas supply port 4*b* and above the gas discharge port 4*d*. Further, in a case where the volatilization of the volatile component of the spinning dope D can be sufficiently performed by the first and second gases, the third gas supply port 4*c* and the third gas supply path R3 may be omitted. Further, in a case where the third gas is not used or the like, the gas discharge port 4*d* and the discharge path R4 may be omitted.

As described above, in the present embodiment, the spinning dope D immediately after being extruded from the spinneret holes 5*a* comes into contact with the first gas supplied by the first gas supply path R1 from above the spinneret 5, thereby being dried relatively slowly. As a result, the spinning dope D immediately after being extruded from the spinneret holes 5*a* is prevented from drying rapidly, the spinning dope D can be drawn while preventing filament breakage, and thus the draft V2/V1 can be improved.

Further, the spinning dope D extruded from the spinneret holes 5*a* comes into contact with the second gas supplied by the second gas supply path R2 from below the spinneret 5, thereby promoting drying. As a result, the spinning dope D can be dried while preventing the occurrence of filament breakage caused by a plurality of streams of the spinning dope D coming into contact with each other during drying in the spinning cabinet 4. Further, the second gas can be supplied to the interior space S of the spinning cabinet 4 separately from the first gas, making it possible to easily control the temperatures and supply amounts of the first gas and the second gas individually. Thus, the spinning efficiency can be improved.

Further, the spinning apparatus 1 includes the third gas supply path R3, and thus the spinning dope D dried to a certain degree by the second gas can be further dried by the third gas supplied from the third gas supply path R3.

Further, the gas discharge port 4*d* of the spinning cabinet 4 is disposed between the position at which the second gas is supplied to the spinning cabinet 4 and the position at which the third gas is supplied to the spinning cabinet 4, and thus, in the interior space S of the spinning cabinet 4, the third gas can be made to flow upward from below, from the position at which the third gas is supplied toward the position of the gas discharge port 4*d*, and a gas having a low volatile component concentration can be brought into contact with the spinning dope D transported through the interior space S to efficiently dry the spinning dope D.

Further, the first gas supply path R1 is disposed so as to be capable of supplying the first gas in the longitudinal direction of the spinning cabinet 4 from above the spinneret 5 toward below the spinneret 5, and thus the spinning dope D can be slowly dried by the first gas while preventing streams of the spinning dope D immediately after being extruded from each of the spinneret holes 5*a* from coming into contact with each other due to the occurrence of filament sway caused by the first gas, and the draft V2/V1 can be improved.

Relationship Between Winding Speed V2 of Godet Roller 8 and Maximum Draft V2/V1

Figure 2:
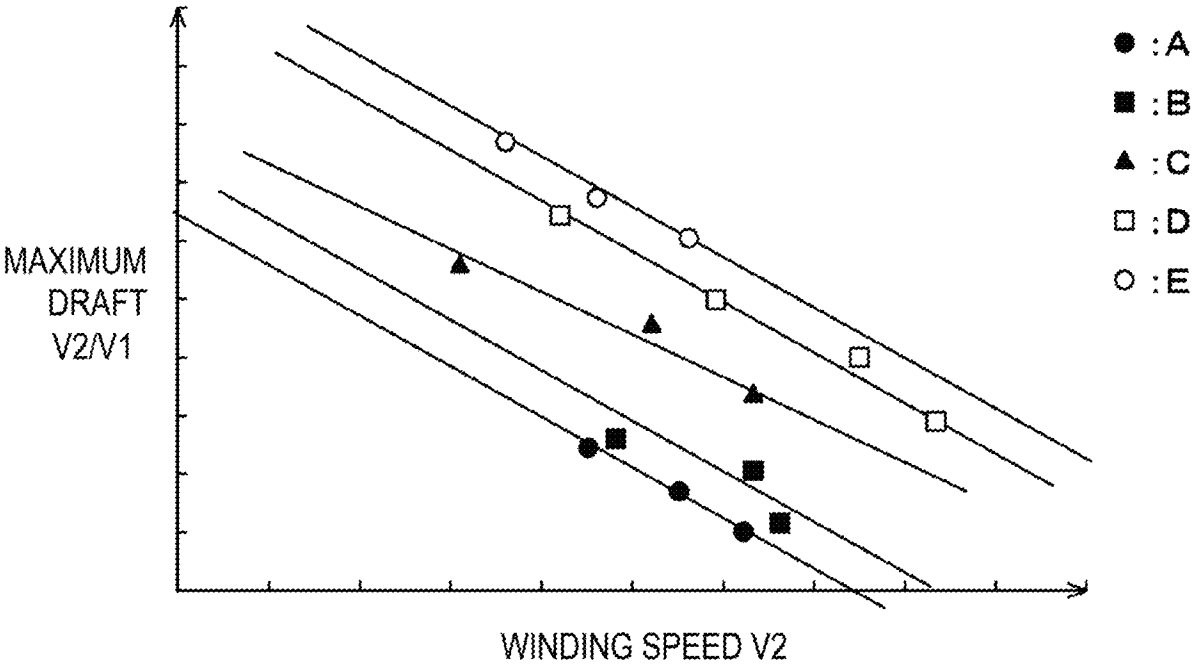
FIG. 2 is a graph showing a relationship between a winding speed of a godet roller and a maximum draft.

FIG. 2 is a graph showing a relationship between the winding speed V2 of the godet roller 8 and the maximum draft V2/V1. FIG. 2 shows the relationship between the winding speed V2 of the godet roller 8 and the maximum draft V2/V1 when, using the spinning apparatus 1 with the first gas supply port 4*a* closed and the position of the second gas supply port 4*b* changed to a lateral position of the spinning cabinet 4 overlapping with the spinneret 5, the filament F is spun by setting the temperature of the second gas supplied to the interior space S and the supply amount of the second gas to the interior space S per unit time to different values. The spinneret 5 was configured to include 100 of the spinneret holes 5*a*, each having a triangular shape.

In FIG. 2, settings A to C are configured to have equivalent supply amounts of the second gas to the interior space S per unit time, and the temperatures of the second gas supplied to the interior space S become lower in the order of A, B, and C. Settings C to E are configured to have equivalent temperatures of the second gas supplied to the interior space S, and the supply amounts of the second gas to the interior space S per unit time become smaller in the order of the settings C, D, E.

As shown in FIG. 2, for any of the settings A to E, when the winding speed V2 increases, the maximum draft V2/V1 decreases. This is thought to be because, for example, a tension acting in the transport direction on the spinning dope D extruded from the spinneret holes 5*a* increases, which makes it easy for filament breakage to occur.

Further, in any of the settings A to E, when the temperature of the second gas supplied to the interior space S rises, the maximum draft V2/V1 decreases. This is thought to be because, for example, the spinning dope D immediately after being extruded from the spinneret holes 5*a* is rapidly dried by the second gas having a relatively high temperature and becomes difficult to draw, which makes it easy for filament breakage to occur.

Further, even when the temperature of the second gas supplied to the interior space S and the winding speed V2 are equivalent as indicated by the settings C and D, the maximum draft V2/V1 decreases when the supply amount of the second gas to the interior space S per unit time is large. This is thought to be because, for example, the spinning dope D immediately after being extruded from the spinneret holes 5*a* is rapidly dried by a relatively large amount of the second gas and becomes difficult to draw, which makes it easy for filament breakage to occur.

In contrast, in the spinning apparatus 1 according to the present embodiment, the spinning dope D immediately after being extruded from the spinneret holes 5*a* is slowly dried by the first gas having a lower temperature than the second gas, thereby facilitating the drawing of the spinning dope D in the transport direction and, as a result, making it possible to improve the maximum draft V2/V1 at a winding speed V2 equivalent to that in the related art. Thus, even in a case where the winding speed V2 is increased, a reduction of the maximum draft V2/V1 can be suppressed compared to the related art. Accordingly, filament breakage that occurs in the spinning cabinet 4 is prevented, making it possible to improve the spinning efficiency.

Confirmation Test

The spinning cabinet 4 illustrated in FIG. 1 was fabricated as an example. Further, a spinning cabinet having a same configuration with the example except that the first gas supply port 4*a* of the spinning cabinet 4 was closed and the position of the second gas supply port 4*b* was changed to a lateral position of the spinning cabinet 4 overlapping with the spinneret 5 was fabricated as a comparative example.

The same spinneret 5 was disposed on the upper ends of the spinning apparatuses of the example and the comparative example, and spinning was performed using the same spinning dope D. As a result, in the example, insufficient drying of the spinning dope D after extrusion from the spinneret holes 5*a* was suppressed to the same extent as in the comparative example, and the winding speed V2 could be increased by approximately 23.7% compared to the comparative example while keeping the maximum draft V2/V1 at a constant value. Thus, in this example, it was found that the maximum draft V2/V1 is easily improved compared to the comparative example.

Furthermore, according to another study by the inventors of the present application, it was found that, as the position of the gas discharge port 4*d* is moved to the lower side of the spinning cabinet 4 between the second gas supply port 4*b* and the third gas supply port 4*c*, the filament sway of the spinning dope D caused by the second gas is less likely to occur, and the maximum draft V2/V1 is easily improved. Nevertheless, it was also found that, as the position of the gas discharge port 4*d* is moved to the lower side of the spinning cabinet 4, the drying of the spinning dope D becomes more likely to be delayed. Thus, it is considered preferable to dispose the gas discharge port 4*d* in an appropriate position in the spinning cabinet 4 in accordance with the raw material component of the filament F to be spun, a filament denier (FD), the speeds V1, V2, and the like.

Further, it was found that, as the position of the second gas supply port 4*b* is moved to the upper side of the spinning cabinet 4, the drying of the spinning dope D transported through the interior space S can be promoted by the second gas, thereby tending to prevent filament breakage due to contact between the plurality of streams of the spinning dope D. Thus, it is considered preferable to dispose the position of the second gas supply port 4*b* on the upper side of the spinning cabinet 4 within a range in which the spinning dope D can be slowly dried by the first gas.

The present inventions are not limited by the embodiments disclosed above, and the configurations and the methods of these embodiments can be changed, added, or deleted, without departing from the spirit of the present inventions.

As described above, the present inventions have excellent effects of improving spinning efficiency in a spinning apparatus by preventing filament breakage that occurs in a spinning cabinet. It is thus advantageous to widely apply one or more of the present inventions to spinning apparatuses that can exhibit the significance of this effect.

What is claimed is:

1. A spinning apparatus for spinning a filament by a dry spinning, comprising:

a spinning cabinet extending in a vertical direction;

a spinneret including a plurality of spinneret holes, the spinneret being disposed on an upper end side of the spinning cabinet and configured to extrude a spinning dope from the plurality of spinneret holes into an interior space of the spinning cabinet;

a first gas supply path connected to the spinning cabinet and configured to supply a first gas from above the spinneret to the interior space, allowing the first gas to come into contact with the spinning dope extruded from the plurality of spinneret holes; and a second gas supply path connected to the spinning cabinet and configured to supply a second gas having a higher temperature than that of the first gas from below the spinneret to the interior space, allowing the second gas to come into contact with the spinning dope extruded from the plurality of spinneret holes, wherein a supply amount of the first gas per unit time being less than a supply amount of the second gas per unit time, wherein the spinning apparatus is configured to spin the filament by the dry spinning.

2. The spinning apparatus according to claim 1, further comprising:

a third gas supply path connected to the spinning cabinet, below a position at which the second gas is supplied to the spinning cabinet, and configured to supply a third gas to the interior space, allowing the third gas to come into contact with the spinning dope extruded from the plurality of spinneret holes.

3. The spinning apparatus according to claim 2, wherein the spinning cabinet includes a gas discharge port configured to discharge a gas from the interior space to outside the spinning cabinet, and the gas discharge port is disposed between the position at which the second gas is supplied to the spinning cabinet and a position at which the third gas is supplied to the spinning cabinet.

4. The spinning apparatus according to claim 1, wherein the first gas supply path is disposed so as to be capable of supplying the first gas in a longitudinal direction of the spinning cabinet, from above the spinneret toward below the spinneret.

5. A method of spinning a filament by a dry spinning, comprising:

extruding a spinning dope from a plurality of spinneret holes of a spinneret positioned at an upper end side of a spinning cabinet, into an interior space of the spinning cabinet which extends in a vertical direction;

supplying a first gas from above the spinneret to the interior space, allowing the first gas to come into contact with the spinning dope passing through the plurality of spinneret holes; and supplying a second gas having a higher temperature than that of the first gas from below the spinneret to the interior space, allowing the second gas to come into contact with the spinning dope extruded from the plurality of spinneret holes, a supply amount of the first gas per unit time being less than a supply amount of the second gas per unit time, wherein the spinning of the filament is conducted by the dry spinning.

6. The spinning method according to claim 5, further comprising:

supplying a third gas to the interior space below a position at which the second gas is supplied to the spinning cabinet, allowing the third gas to come into contact with the spinning dope extruded from the plurality of spinneret holes.

7. The spinning method according to claim 6, wherein discharging a gas from the interior space to outside the spinning cabinet, at a position vertically between the position at which the second gas is supplied to the spinning cabinet and a position at which the third gas is supplied to the spinning cabinet.

8. The spinning method according to claim 5, wherein the first gas is supplied from above the spinneret toward below the spinneret.

9. A method of spinning a filament by a dry spinning, comprising:

extruding a spinning dope from a plurality of spinneret holes of a spinneret into an interior space of a spinning cabinet;

supplying a first gas at a first temperature and a first gas supply rate, into the interior space of the spinning cabinet, from a first supply position above the spinneret, into contact with the spinning dope passing through the plurality of spinneret holes; and supplying a second gas at a second temperature and a second gas supply rate, into the interior space at a second supply location below the spinneret, into contact with the spinning dope extruded from the plurality of spinneret holes, the second temperature being higher than the first temperature and the first gas supply rate being less than the second gas supply rate, wherein the spinning of the filament is conducted by the dry spinning.

10. The spinning method according to claim 9 additionally comprising supplying a third gas into the interior space from a third supply location, below the second supply location, and into contact with the spinning dope extruded from the plurality of spinneret holes.

11. The spinning method according to claim 10 additionally comprising discharging a gas from the interior space to outside the spinning cabinet at a discharge location positioned vertically between the second gas supply location and the third gas supply location.

12. The spinning method according to claim 9, wherein the first gas is supplied from above the spinneret toward below the spinneret.

* * * * *